United States Patent [19]

Krieg et al.

[11] Patent Number: 4,564,783

[45] Date of Patent: Jan. 14, 1986

[54] HALOGEN INCANDESCENT LAMP-AND-REFLECTOR UNIT

[75] Inventors: Rudolf Krieg, Munich; Friedrich Ziegler, Wolfratshausen, both of Fed. Rep. of Germany

[73] Assignee: Patent-Treuhand Gesellschaft für Elektrische Glühlampen GmbH, Munich, Fed. Rep. of Germany

[21] Appl. No.: 501,422

[22] Filed: Jun. 6, 1983

[30] Foreign Application Priority Data

Jul. 9, 1982 [DE] Fed. Rep. of Germany ... 8219740[U]

[51] Int. Cl.[4] ..... H01K 1/26

[52] U.S. Cl. ..... 313/113; 313/117; 313/579; 313/580; 362/343; 362/344

[58] Field of Search ..... 313/113, 117, 579, 580; 362/303, 299, 300, 306, 343, 344, 304, 305

[56] References Cited

U.S. PATENT DOCUMENTS

| | | | |
|---|---|---|---|
| 2,294,007 | 8/1942 | Trautner | 362/299 |
| 3,553,519 | 1/1971 | Hicks | 313/113 |
| 3,553,520 | 1/1971 | Hicks | 313/113 |
| 3,904,904 | 9/1975 | Meinecke et al. | 313/113 |
| 4,135,232 | 1/1979 | Berkenhoff | 362/306 |
| 4,210,954 | 7/1980 | Laser | 362/303 |
| 4,225,903 | 9/1980 | Buchleitner | 362/344 |

FOREIGN PATENT DOCUMENTS

| | | | |
|---|---|---|---|
| 140373 | 3/1949 | Australia | 362/303 |
| 69268 | 6/1941 | Czechoslovakia | 362/303 |
| 1280334 | 2/1961 | France | 362/300 |
| 449575 | 6/1936 | United Kingdom | 362/303 |
| 1438253 | 6/1976 | United Kingdom | 313/113 |

*Primary Examiner*—Steven Weinstein

*Attorney, Agent, or Firm*—Frishauf, Holtz, Goodman & Woodward

[57] ABSTRACT

To prevent direct radiation from a halogen incandescent lamp-reflector unit, while permitting easy removal of the unit by grasping a holding element (8) for a radiation-preventing cap (6'), the holding element is made in the form of a flat sheet-metal strip (8) spanning the rim of the reflector (5). The flat sheet-metal element has a black surface finish and is secured to the reflector, for example by projecting flaps (10) engaging through slits (13) formed in the reflector, and twisted to secure the strip in position. The cap, likewise,is formed with slits (11, 11') engaged by projections (9, 12) and likewise held in position by twisting a central one (12) of the projections, the other projections preventing rotation of the cap with respect to the holding strip. The arrangement permits ready placement or exchange of the lamp from a fitting by grasping the holding strip, without thereby causing change in the optical characteristics of the halogen incandescent bulb (4)-reflector (5) combination.

4 Claims, 6 Drawing Figures

HALOGEN INCANDESCENT LAMP-AND-REFLECTOR UNIT

The present invention relates to a unitary reflector-lamp element using a halogen incandescent lamp as the light source, and more particularly to a light source and reflector unit especially adapted for spot illumination, special lighting effects, and the like.

BACKGROUND

Halogen incandescent lamps combined with reflectors frequently use a cap secured to the lamp reflector to prevent direct radiation from the halogen incandescent light source. Such lamps are suitable for many applications and are frequently used for special illumination effects, for spot illumination, and the like.

The cap usually is carried by narrow support strips or bars which extend, customarily, towards the base region of the reflector lamp, to be secured thereto. They do not extend quite parallel to the axis of the lamp, but rather usually at an acute angle with respect thereto. The ends of these attachment strips or pins penetrate the reflector in the vicinity of its base or apex and are secured to the reflector housing in a suitable manner. The lamp-reflector unit may have various types of bases, for example fitting a bayonet-type socket.

To place a lamp of this type into the socket, to remove a lamp for other use, and the like, it is frequently difficult to grasp the reflector due to constraints of space and mounting unit or combination in fittings and the like. To exchange or place lamps, thus, it is frequently necessary to grasp the lamp at the cap thereof, or on the support pins or strips which hold the cap to the reflector. Since the caps are light, the support strips or pins likewise are not designed as sturdy structural supports and, upon grasping the cap to mount the unit in a socket, it is easily possible to bend the narrow pins or strips, resulting in an undesirable shift in position of the cap with respect to the halogen incandescent light bulb. This detrimentally affects the optical characteristics of the lamp-reflector unit.

THE INVENTION

It is an object to provide a reflector lamp in which the lamp-reflector unit can be easily grasped and positioned as desired without interfering with the predetermined optical characteristics of the lamp as determined by the position of a shielding cap with respect to the bulb and the reflector.

Briefly, the cap is supported by a holding strip in form of a flat sheet metal element which bridges the rim of the reflector. The holding strip extends transversely of the reflector, extending in bridge-like form, preferably bowed upwardly, from an end portion of the reflector to a diametrically opposite end portion. The holding strip is secured to the reflector in the vicinity of the rim thereof. The strip has its flat surface positioned in a plane parallel to the axis of the reflector, preferably intersecting the reflector axis.

In accordance with a feature of the invention, the strip is formed with flaps and projections which can be passed through suitable matching openings in the edge of the reflector, for attachment thereto simply by twisting the end portions of the projections to provide a combined friction-mechanical engaging connection. The cap, likewise, may be formed with suitable openings into which projections of the strip can be passed to secure the cap to the strip. Of course, the interengaging connections betwen the cap and the strip may be reversed. The strip, preferably, is made of metal with a black finish.

DETAILED DESCRIPTION

Figure 1:
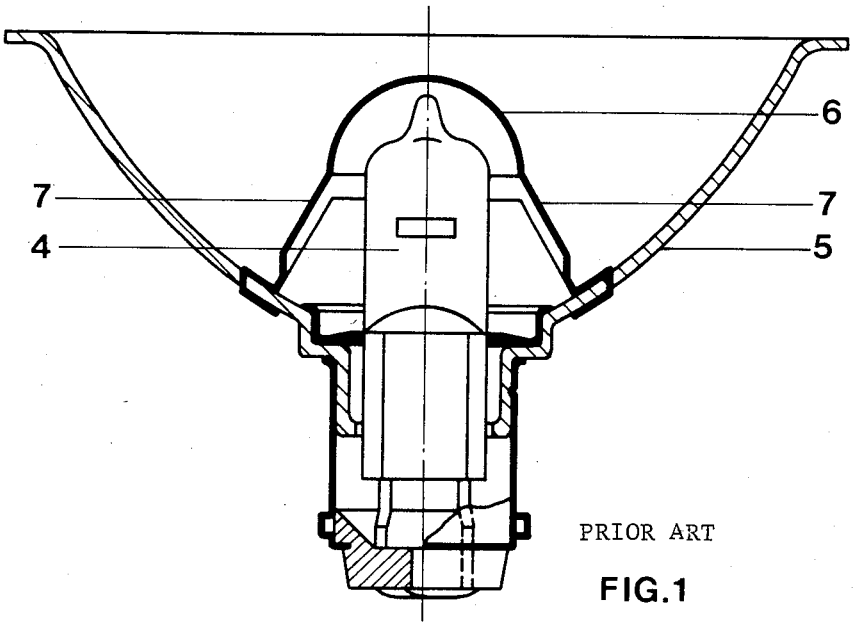
PRIOR ART FIG.1
FIG. 1 illustrates an axial cross section through a reflector lamp in accordance with the prior art.

The reflector lamp combination in accordance with the prior art—see FIG. 1—has a metal reflector 5 into which a halogen incandescent light bulb 4 is secured, and attached to the reflector to form a complete solid structural unit. Direct radiation from the halogen incandescent lamp 4 is prevented by a cap 6, made of black-finished or black-surfaced metal. This cap 6 surrounds the tip of the bulb 4. The cap has projecting legs 7, in the form of sheet-metal strips or pins, which, customarily, are narrow and fragile. The legs 7 extend at an acute angle with respect to the axis of the lamp in downward direction, and pass through openings formed in the metal reflector 5, and are attached thereto, for example by a U-crimp, as shown in FIG. 1. If it is desired to rotate the lamp while depressing it against a spring force, for example to remove the lamp from a bayonet socket, twisting the legs 7 can readily occur, resulting in a shift of the cap 7 with respect to the bulb, thus changing the optical characteristics of the lamp and possibly damaging the halogen incandescent bulb 4 as well.

Figure 2:
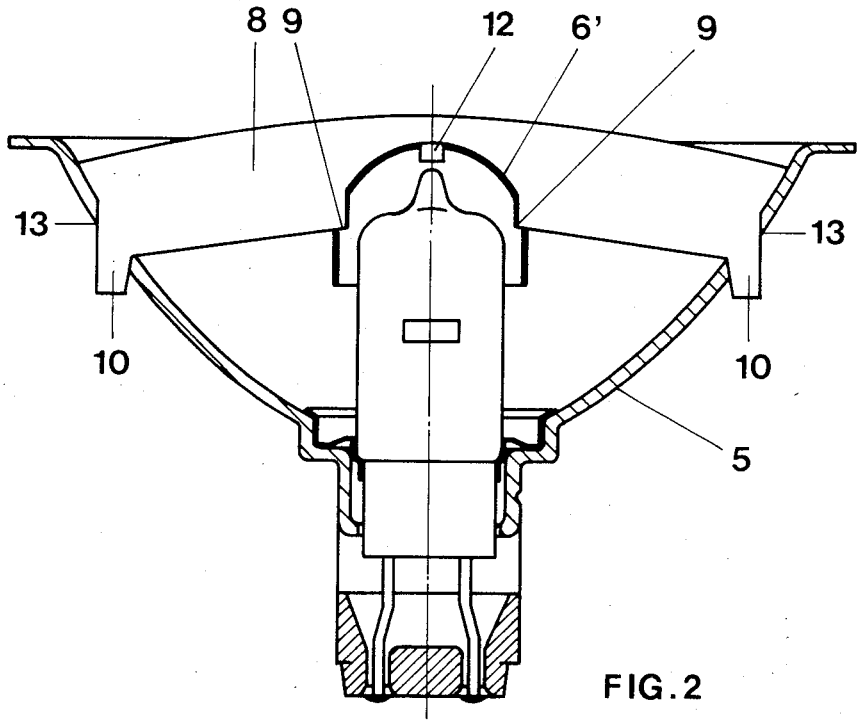
FIG. 2 is a view similar to FIG. 1 illustrating the arrangement in accordance with the present invention.
Figure 3:
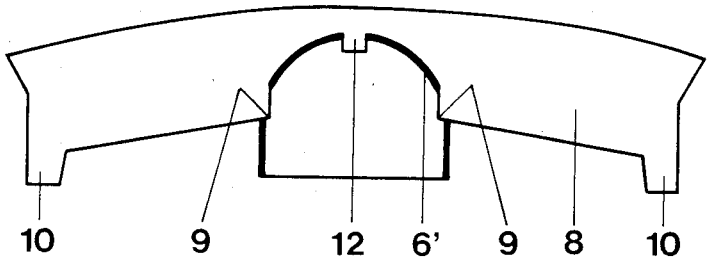
FIG. 3 is a plan view of the strip, with the cap attached.
Figure 4:
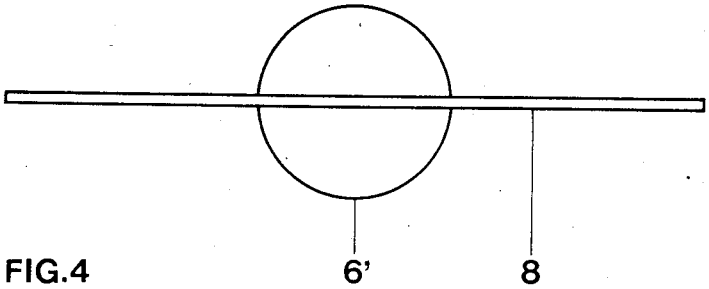
FIG. 4 is an end view of the strip with the cap attached.
Figure 5:
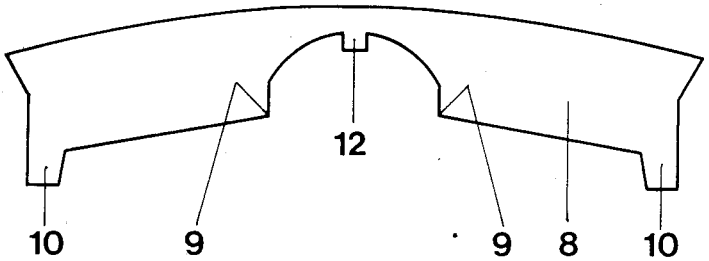
FIG. 5 is a plan view of the strip, without the cap.
Figure 6:
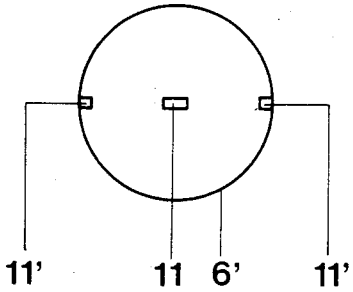
FIG. 6 is an end view of the cap alone.

In accordance with the invention—see FIG. 2—the cap 6' is secured to a flat sheet-metal element 8, made of black-finished metal, which spans the open portion of the reflector 5. The strip 8 has a wide surface and is secured close to the rim of the opening of the reflector. The strip 8—see FIGS. 3, 4 and 5—has end projections or flaps 10 which fit through suitably formed openings 13 in the end portion of the reflector 5. They can be secured to the reflector 5 by twisting the flaps 10. To match cap 6', the strip 8 is formed with a matching recess which, at the sides, leaves projections 9 and, in the center, a projecting tongue 12. The projections 9 and the tongue 12 engage into matching slits 11 and 11' (FIG. 6) respectively in the cap 6'. The projections 9 need not be deformed from the flat shape; they function primarily to insure seating of the cap and preventing rotation thereof with respect to the strip 8. The center tongue 12 can receive a twist, and thus reliably hold the cap 6' in the cut-out in the central portion of the strip 8. The strip 8, preferably, is somewhat bowed—see FIGS. 2, 3, 5—and extends bridge-like across the free openings of the reflector.

To exchange the lamp-reflector unit, or seat the lamp-reflector unit in a socket as receptacle, it is only necessary to grasp the flat strip 8 at the two sides of the cap and place the lamp in position. The position of the cap with respect to the bulb 4 remains unchanged in this operation.

We claim:

1. Halogen incandescent lamp and reflector unit having a generally cup-shaped metal reflector (5) having a base and a rim at the open end thereof;

a halogen incandescent lamp bulb (4) secured and mounted in the reflector through the base of reflector;

and a shielding cap (6') covering the tip of the bulb to prevent direct radiation from the lamp, the improvement comprising means for reliably and permanently holding the shielding cap in position with respect to the bulb (4) and the reflector (5) even upon application of twisting force and, selectively, of a pushing force about the lamp axis and, selectively, towards the lamp base applied to the shielding cap, said means consisting of a holding strip (8) to which the cap (6') is secured, the holding strip being formed with a central cut-out having the outer shape of the cap (6'), the cap fitting into the cut-out and being engaged by the region of the strip (8) surrounding the central cut-out, said holding strip being in form of a flat sheet-metal element extending transversely of the reflector in form of a bridge, from a first end portion of the reflector to a diametrically located second end portion of the reflector to span said reflector, said holding strip (8) being positioned in a plane parallel to the axis of the reflector;

the holding strip being formed with flaps (10) adjacent its end portions;

the reflector being formed with slits (13) adjacent the rim thereof matching said flaps, said flaps (10) of the holding strip being secured in said slits by twist deformation of the flaps after having been introduced through the slits of the reflector;

the cap (6') is formed with at least two slits (11, 11') in the region of engagement with the strip (8); and at least a first and second projection (11, 11') is formed on the strip (8), extending from the strip, matching respective slits (11, 11') in the cap (6') and fitting through respective ones of said slits in the cap, at least a first one of the projections (12) securing the cap (6') in position by deformation of said at least first one projection after having been introduced through the respective slit (11), and a second projection (9) fitting through a matching other one of the slits (11') and retaining the cap in the cut-out of the strip (8) in non-rotatable and secure engagement against said central cut-out.

2. Unit according to claim 1, wherein the holding strip (8) comprises a flat sheet-metal element having a black surface finish.

3. Lamp-and-reflector unit according to claim 1, wherein the cap (6') is formed with three slits (11, 11'), two of the slits (11') being located at diametrically opposite portions of the cap (6'), and each receiving a projection in the form of a projecting flap (9) formed on the strip (8) engaging the diametrically opposite portions of the cap, said first projection (12) from the strip (8) and one of said slits (11) being located centrally in the cap, and retaining said cap in engagement with the strip, the diametrically opposite projecting flaps in the oppositely located slits (11') reliably preventing rotation of the cap with respect to said strip by engagement of diametrically opposite portions thereof.

4. Unit according to claim 3, wherein the holding strip (8) comprises a flat sheet-metal element having a black surface finish.

* * * * *